US006652908B1

(12) United States Patent
Guldbrandsen et al.

(10) Patent No.: US 6,652,908 B1
(45) **Date of Patent: *Nov. 25, 2003**

(54) APPLICATION OF PRESSURE SENSITIVE COATING TO SUBSTRATE FROM ROLLER HAVING A FLUID FILM THEREON

(75) Inventors: Lars Guldbrandsen, Hamburgh (DE); Ralf Hirsch, Quickborn (DE); Dieter Müller, Kutenholz-Mulsum (DE); Hermann Neuhaus-Steinmetz, Ahrensberg (DE); Stefan Schulz, Hamburg (DE); Jörg Speer, Brokstedt (DE)

(73) Assignee: tesa AG, Hamburg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/937,742

(22) PCT Filed: Feb. 10, 2000

(86) PCT No.: PCT/EP00/01062

§ 371 (c)(1),
(2), (4) Date: Nov. 29, 2001

(87) PCT Pub. No.: WO00/47336

PCT Pub. Date: Aug. 17, 2000

(30) Foreign Application Priority Data

Feb. 12, 1999 (DE) ..... 199 05 935

(51) Int. Cl.[7] ..... B05D 5/10; B05D 1/28

(52) U.S. Cl. ..... 427/208.8; 427/505; 427/516; 427/561; 427/566; 427/208.4; 427/428

(58) Field of Search ..... 427/428, 505, 427/516, 561, 566, 208.4, 208.8

(56) References Cited

U.S. PATENT DOCUMENTS 6,086,699 A * 7/2000 Nakashima et al. ..... 156/230
6,472,025 B1 * 10/2002 Guldbrandsen et al. ..... 427/487

FOREIGN PATENT DOCUMENTS

| | | |
|---|---|---|
| EP | 0 604 075 | 6/1994 |
| EP | 0 609 484 | 8/1994 |
| EP | 0 622 127 | 11/1994 |
| GB | 2 213 406 | 8/1989 |
| WO | 90/06184 | 6/1990 |

OTHER PUBLICATIONS

The Condensed Chemical Dictionary, Tenth Edition, Van Nostrand Reinhold Company, 1981, p. 958.*

* cited by examiner

*Primary Examiner*—Katherine A. Bareford
(74) *Attorney, Agent, or Firm*—Norris McLaughlin & Marcus

(57) ABSTRACT

A method of producing a coating of solvent-free pressure-sensitive adhesive systems on substrates, especially release-coated substrates, in which a fluid film is applied to a rotating roller by means of a fluid applicator, the pressure-sensitive adhesive system is applied in one or more layers to the fluid film by means of an adhesive applicator, and the roller is contacted with the substrate, so that the pressure-sensitive adhesive system is transferred from the roller to the substrate.

12 Claims, 1 Drawing Sheet

APPLICATION OF PRESSURE SENSITIVE COATING TO SUBSTRATE FROM ROLLER HAVING A FLUID FILM THEREON

This application is a 371 of PCT/EP00/01062, filed Feb. 10, 2000.

The invention concerns a method of producing a coating of solvent-free pressure-sensitive adhesive systems on substrates, especially release-coated substrates, the operation of coating running by way of a roller.

BACKGROUND OF THE INVENTION

EP 0 622 127 B1 discloses that, by way of a roller, pressure-sensitive, solvent-free adhesive coats are placed onto a substrate. The application device used comprises single-manifold or multimanifold dies.

Owing to an applied difference in speed between the coated roller or the receiving substrate, the premetered adhesive film is reduced in its thickness, so that thin pressure-sensitive adhesive coats can be transferred to substrates.

A disadvantage of the known method is that pressure-sensitive adhesive coats can be received from smooth, untreated rollers only by nonrelease-coated substrates, or that the roller coated with the pressure-sensitive adhesive must exhibit a release effect, which can be produced by way of a fluorocarbon coat or Teflon coat. This release coat diminishes in the course of its lifetime and is sensitive to external influences such as wear, dirt, and mechanical damage. Furthermore, release rollers produced with fluorocarbon or Teflon coatings lack sufficient release properties with respect to acrylate hot-melt pressure-sensitive adhesives in the case of machine stoppages, so that the result is not a robust process without laborious cleaning operations of the coated roller in conjunction with down times.

Likewise known from the prior art is the gravure roller coating method, with hot-melt adhesives metered by way of a die.

The disadvantage of the gravure roller method, however, is that, depending on the type of hot-melt adhesive, the structure of the engraved roller surface is transferred to the adhesive film when the coat of adhesive is transferred to a substrate. A further disadvantage of the gravure roller coating method is that, at relatively high coating speeds, full discharge of the engraved structures is not possible and there may therefore be uneven application of adhesive. With release-coated substrates, moreover, the reception of the adhesive film by structured roller surfaces is again very difficult.

It is an object of the present invention to provide a method of producing a solvent-free pressure-sensitive adhesive coating on substrates, especially release-coated substrates, which avoids the disadvantages of the prior art.

SUMMARY OF THE INVENTION

The invention accordingly describes a method of producing a coating of solvent-free pressure-sensitive adhesive systems on substrates, especially release-coated substrates, in which a fluid film is applied to a rotating roller by means of a fluid applicator, the pressure-sensitive adhesive system is applied in one or more layers to the fluid film by means of an adhesive applicator, so that the fluid film is located between roller and pressure-sensitive adhesive system, and the roller is contacted with the substrate, so that the pressure-sensitive adhesive system is transferred from the roller to the substrate (release-coated and nonrelease-coated).

DETAILED DESCRIPTION

The contacting of the substrate takes place in particular by way of a second roller. Substrates used include papers, films, nonwovens and release-coated materials such as release papers, films, and the like.

The second roller, also referred to as the contact roller, preferably has a rubber coating and is pressed against the roller with a linear pressure of preferably from 50 to 500 N/mm, in particular at from 100 to 200 N/mm. The contact roller preferably has a Shore hardness (A) of 40–100, in particular a Shore hardness of 60–80 shore (A).

The substrate is preferably brought into contact with the roller in such a way that the speed of the roller surface coincides with that of the substrate. Where, however, it is intended that a reduction in thickness should take place along with the reception of the adhesive film, the substrate may also have a higher speed.

In a first advantageous embodiment, the roller is a steel roller, a chrome-plated steel roller, a rubber roller or a silicone rubber roller and or is manufactured from elastic material. Furthermore, the roller may be smooth or may have a slightly structured surface. The smooth roller may preferably have a chrome coating, Optionally, the chrome-plated steel roller may possess a high-gloss-polished surface with a roughens $R_z$<+/−1$\mu$m.

The coating roller may also, however, be rubberized, preferably with a rubber hardness of from 40 to 100 shore (A), in particular with a hardness of 60–80 shore (A). The roll coating may, in accordance with the prior art, comprise ethylene-propylene terpolymer (EPDM), VITON® fluoroelastomer or silicone rubber, or other elastic materials.

It has also proven advantageous for the roller to be temperature-controllable, preferably in a range from −10° C. to 200° C., with very particular preference from 2° C. to 50° C.

The placement of the pressure-sensitive adhesive system onto the roller takes place in particular by means of a single-channel or multichannel nozzle or a slot die. The fluid-laden roller is preferably coated contactlessly with the adhesive film emerging from the die. The distance of the die from the roller may be preferably from 0 to 60 mm, in particular from 1 to 10 mm.

Furthermore, the fluid applicator should also be temperature-controllable, in order to bring agents which are present in but insensitive to the adhesive formulation to temperatures associated with desired fluid properties.

The fluid may be wiped on or carried on; it is, however, also possible for the fluid to be brought onto the roller contactlessly, by spraying, for example.

In another advantageous embodiment of the invention, the pressure-sensitive film is crosslinked prior to transfer to the substrate, in particular by means of electron beams, UV rays or a combination of the two techniques.

Typical exposure means employed in the context of the inventive embodiment of the method are linear cathode systems, scanner systems, or multiple longitudinal cathode systems, where the equipment in question comprises electron beam accelerators.

The acceleration voltages are situated in the range between 40 kV and 350 kV, preferably from 80 kV to 300 kV. The output doses range between 5 and 150 kGy, in particular from 20 to 90 kGy.

As UV crosslinking units it is possible in particular to employ two medium-pressure mercury lamps each with an output of 120 W/cm or one medium-pressure mercury lamp having an output of 240 W/cm. The doses set are preferably from 10 to 300 mJ/cm$^2$.

The pressure-sensitive adhesive film may be crosslinked thermally, by way of the temperature of the coated roller, and it is also possible for thermal crosslinking to be used supplementarily.

The fluid film is preferably water and/or distilled water, with or without additions such as alcohol, wetting agents and/or agents insensitive to the adhesive formulation, such as plasticizers or liquid aging inhibitors.

To achieve uniform wetting, the surface tension of the fluid should be lower than the surface tension of the roller that is to be wetted.

As the pressure-sensitive adhesive system, use is made in particular of acrylic, natural rubber, synthetic rubber or EVA adhesives.

Examples of low molecular mass acrylic hotmelts employed include copolymers of (meth)acrylic acid and esters thereof having from 1 to 25 carbon atoms, maleic, fumaric and/or itaconic acid and/or their esters, substituted (meth)acrylamides, maleic anhydride, and other vinyl compounds, such as vinyl esters, especially vinyl acetate, vinyl alcohols and/or vinyl ethers.

The acrylic hotmelts may further be blended with one or more additives such as aging inhibitors, crosslinkers, light stabilizers, ozone protectants, fatty acids, resins, plasticizers, and accelerators.

Furthermore, they may have been filled with one or more fillers such as fibers, carbon black, zinc oxide, solid microbeads, silica, silicates, and chalk, the addition of blocking-free isocyanates also being possible.

In the case of rubber/synthetic rubber as a starting material for the adhesive, further variation possibilities exist, whether said material is from the group of the natural rubbers or the synthetic rubbers or whether it comprises any desired blend of natural rubbers and/or synthetic rubbers, it being possible to select the natural rubber or the natural rubbers, in principle, from all available grades, such as, for example, crepe, RSS, ADS, TSR or CV grades, depending on the required purity and viscosity level, and it being possible to select the synthetic rubber or the synthetic rubbers from the group consisting of randomly copolymerized styrene-butadiene rubbers (SBR), butadiene rubbers (BR), synthetic polyisoprenes (IR), butyl rubbers (IIR), halogenated butyl rubbers (XIIR), acrylic rubbers (ACM), ethylene-vinyl acetate (EVA) copolymers and the polyurethanes and/or blends thereof.

Also, preferably, it is possible to add thermoplastic elastomers with a weight fraction of 10 to 50% by weight, based on the overall elastomer content, to rubbers in order to improve the processing properties.

As representatives, mention may be made at this point, in particular, of the particularly compatible styrene-isoprene-styrene (SIS) and styrene-butadiene-styrene (SBS) types. As tackifier resins to be added, it is possible without exception to use all known tackifier resins, including those described in the literature. As representatives, mention may be made of the rosins, their disproportionated, hydrogenated, polymerized, esterified derivatives and salts, aliphatic and aromatic hydrocarbon resins, terpene resins, and terpene-phenolic resins. Any desired combinations of these and other resins may be used in order to adjust the properties of the resultant adhesive composition in accordance with what is desired. Express reference may be made to the outline of the state of the art in the "Handbook of Pressure Sensitive Adhesive Technology" by Donatas Satas (van Nostrand, 1989).

As plasticizers which are likewise to be added, it is possible to use all plasticizing substances known from adhesive tape technology. These include, inter alia, the paraffinic and naphthenic oils, (functionalized) oligomers such as oligobutadienes, oligoisoprenes, liquid nitrile rubbers, liquid terpene resins, vegetable and animal oils and fats, phthalates, and functionalized acrylates.

In the text below the intention, using a figure and a number of examples, is to illustrate the invention without, however, wishing to subject it to any unnecessary restriction.

Figure 1:
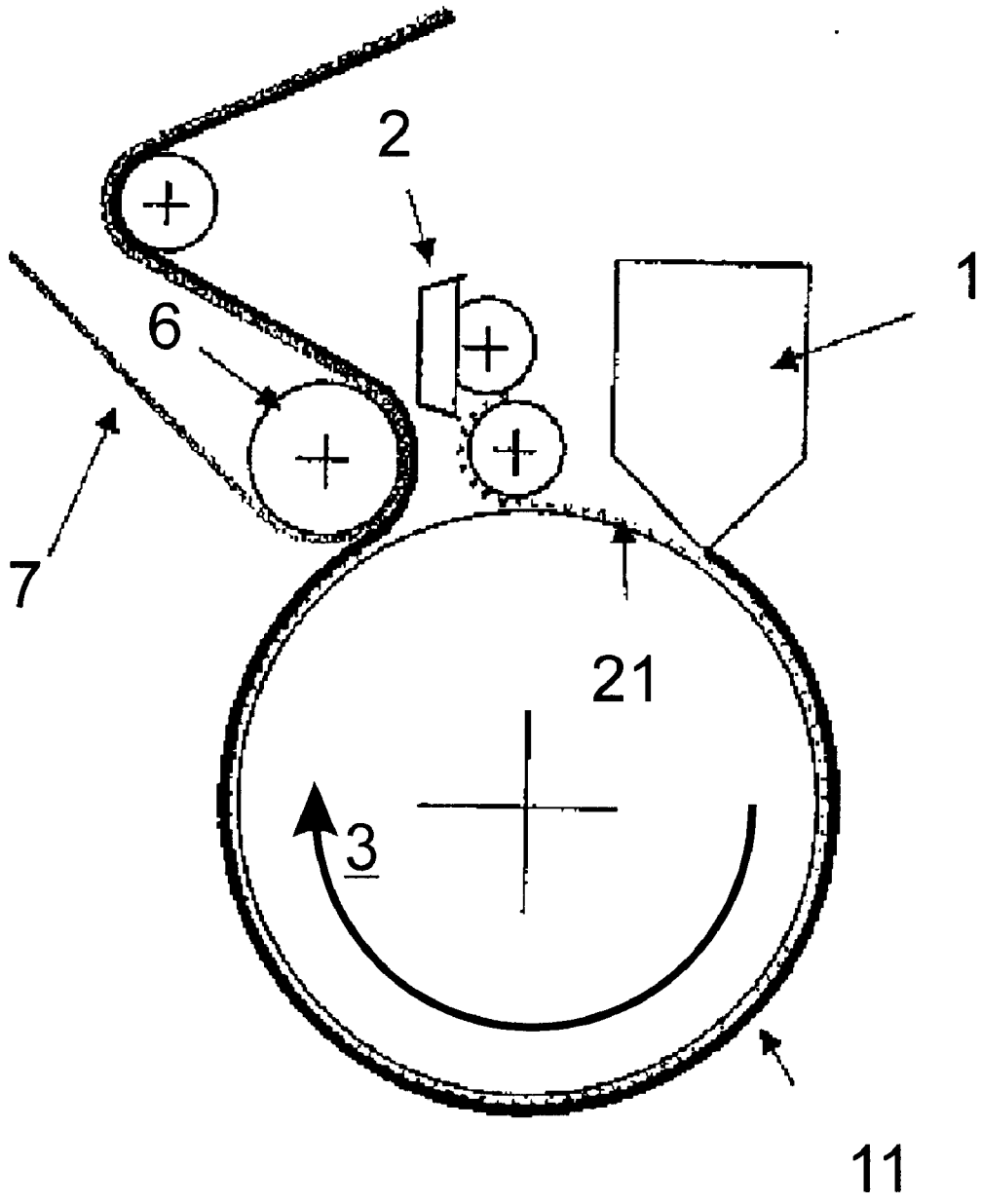
FIG. 1 shows an advantageous embodiment of the method. The nozzle (1) coats the pressure-sensitive hot-melt adhesive (11) onto a roller (3), which may be configured as a smooth roller or as a structured roller. Besides the use of the single-manifold die (1) depicted here, it is also possible to use slot dies or multimanifold dies with, for example, three or more individual layers.

The roller (3) is configured as a chrome-plated steel roller with a high-gloss-polished surface, specifically with a roughness $R_z$<+/−1 $\mu$m.

The fluid film (21) is carried in premetered form onto the roller (3), evenly over the coating width, preferably by way of a roll applicator unit (2) configured in accordance with the prior art. The fluid (21)-laden roller (3) is coated, preferably contactlessly, with the adhesive film (11) emerging from the die (1). The distance of the die (1) from the roller (3) is 5 mm.

The adhesive film (11) placed floatingly onto the roller (3) is subsequently received from the roller (3) by means of a contact roller (6). The contact roller (6) has a rubber coating and is pressed against the roller (3) at a linear pressure of 150 N/mm.

As the substrate (7) which receives the pressure-sensitive adhesive film, a release paper is supplied to the contact roller and the adhesive film (11) is thus transferred to the substrate (7).

The following examples serve for better comprehension of the invention:

Example 1

With the aid of a single-screw extruder (L/D:27), an acrylic hot-melt pressure-sensitive adhesive, as described in DE 39 42 232 or DE 43 13 008, was coated onto a smooth roller at a temperature of 90° C. using a single-manifold die (manufacturer: Breyer), working width 350 mm. The fluid that wetted the smooth roller was water. The temperature of the smooth roller was 20° C.

An adhesive film with a thickness of 20 g/m$^2$ was placed onto the smooth roller and then received from the roller by a corona-pretreated PET film (12 $\mu$m). The coating speed was 70 m/min. The unlined side of the adhesive was then laminated with a release paper. The amount of fluid present on the unlined side of the adhesive was so small that the subsequent lamination of release paper did not bring about any damage to the exposed adhesive side whatsoever.

The composite produced in this way was coated a second time onto the exposed film side, and rolled up.

Example 2

The acrylic hot-melt pressure-sensitive adhesive mentioned in example 1 was coated in a thickness of 130 g/m$^2$ onto a smooth roller under the conditions stated in example 1. The receiving substrate was in this case a silicone release paper having a release value of 5–25 cN/cm. The fluid present on the open side of the adhesive was dried by means of IR radiation shortly before the composite was rolled up.

Example 3

The acrylic pressure-sensitive hotmelt adhesive mentioned in example 1 was received in a thickness of 50 g/m$^2$ by a double-sidedly release-coated PETP film having a release value of 5–9 cN/cm, under the conditions stated in example 2, and the composite was rolled up.

Example 4

A natural rubber hot-melt adhesive was coated onto the smooth roller at a temperature of 120° C. with the aid of the die. The fluid employed was a water/alcohol mixture. Transfer took place onto a creped paper which in an upstream operation had been provided with an impregnation, a primer, and a release.

Example 5

With the aid of a multimanifold die, a three-ply, double-sidedly self-adhesive product system was extruded onto a smooth roller. As the pressure-sensitive hot-melt adhesive, the type described in example 1 was extruded onto the top and bottom sides of an elastomeric middle-coat support with the aid of the multimanifold die. This self-adhesive composite was placed onto the water-covered smooth roller and transferred to a release paper with release forces of 5–30 cN/cm, and the composite was rolled up.

We claim:

1. A method of producing a coating of solvent-free pressure-sensitive adhesive systems on substrates, in which a fluid film is applied to a rotating roller by means of a fluid applicator, the pressure-sensitive adhesive system is applied in one or more layers to the fluid film, and the roller is contacted with the substrate, to transfer the pressure-sensitive adhesive system from the roller to the substrate.

2. The method according to claim 1, wherein the roller is a steel roller, a chrome-plate steel roller, a rubber roller or a silicone rubber roller.

3. The method according to claim 1, wherein the roller is temperature-controlled in a range from −10° C. to 200° C.

4. The method of claim 3, wherein said temperature range is 2°–50° C.

5. The method according to claim 1, wherein the placement of the pressure-sensitive adhesive system onto the roller takes place with the aid of a single-manifold or multi-manifold die or of a slot die.

6. The method according to claim 1, wherein the fluid applicator unit is temperature-controlled.

7. The method according to claim 1, wherein the pressure-sensitive adhesive system is crosslinked prior to transfer to the substrate.

8. The method of claim 7, wherein said pressure sensitive system is crosslinked prior to transfer to the substrate thermally, by ultraviolet rays, by electron beams or any combination thereof.

9. The method according to claim 1, wherein acrylic, natural rubber, synthetic rubber or EVA adhesives are employed as the pressure-sensitive adhesive.

10. The method according to claim 1, wherein the fluid film comprises water, distilled water, or both, with or without additions selected from the group consisting of alcohol, wetting agents, plasticizers and liquid aging inhibitors.

11. The method of claim 1, wherein said roller is manufactured from elastic material.

12. The method of claim 1, wherein said roller is coated with ethylene-propylene terpolymer (EPDM), fluoroelastomer, silicone rubber or other elastic material.

* * * * *